US006735911B1

(12) United States Patent
Alexander

(10) Patent No.: US 6,735,911 B1
(45) Date of Patent: May 18, 2004

(54) EARTH ANCHOR

(76) Inventor: Billy W. Alexander, 2486 Commercial Dr., Pearl, MI (US) 39208

( * ) Notice: Subject to any disclaimer, the term of this patent is extended or adjusted under 35 U.S.C. 154(b) by 0 days.

(21) Appl. No.: 10/377,373

(22) Filed: Feb. 28, 2003

(51) Int. Cl.[7] ..... E02D 5/74
(52) U.S. Cl. ..... 52/155; 52/164; 248/500
(58) Field of Search ..... 52/155, 164; 248/500, 248/508, 509

(56) References Cited

U.S. PATENT DOCUMENTS

| | | | | | |
|---|---|---|---|---|---|
| 1,486,623 | A | | 3/1924 | Arnstein | |
| 1,567,703 | A | | 1/1925 | Broyles | |
| 1,940,430 | A | | 12/1933 | Morterra | |
| 2,025,853 | A | * | 12/1935 | Emry | 52/164 |
| 2,742,865 | A | | 4/1956 | Chandler et al. | |
| 3,685,771 | A | | 8/1972 | Babich | |
| 3,904,154 | A | | 9/1975 | Jones | |
| 4,079,557 | A | * | 3/1978 | Watanabe | 52/164 |
| 4,590,732 | A | * | 5/1986 | Hallman | 52/704 |
| 4,953,576 | A | | 9/1990 | Connelly | |
| 5,080,304 | A | | 1/1992 | Stump et al. | |
| 5,171,108 | A | | 12/1992 | Hugron | |
| 5,243,795 | A | | 9/1993 | Roberts | |
| 5,292,089 | A | | 3/1994 | Whitman et al. | |
| 5,437,128 | A | * | 8/1995 | Gremillion | 52/162 |
| 5,881,506 | A | | 3/1999 | Chapman et al. | |
| 5,988,194 | A | | 11/1999 | Collins | |
| 6,591,564 | B2 | * | 7/2003 | Cusimano | 52/274 |

* cited by examiner

*Primary Examiner*—Ramon O. Ramirez
(74) *Attorney, Agent, or Firm*—Lanier Ford Shaver & Payne P.C.

(57) ABSTRACT

A multi-legged ground-anchoring device is provided for securing objects to fixed points. The device comprises a central hub from which a plurality of legs extends. At the distal end of each respective leg is a foot for the receipt of a spike. The spikes may be driven into the ground at a predetermined angle as dictated by the angle of each foot. When physically connected to the object being secured, nay force acting on the central hub of the device initiates a rotational movement of the legs which forces the spikes to dig deeper into the soil and hold the device more firmly to the ground.

23 Claims, 6 Drawing Sheets

EARTH ANCHOR

BACKGROUND OF THE INVENTION

This invention generally relates to securement devices. In particular, the present invention relates to a device for securing objects to a fixed point. More particularly, the present invention relates to a ground anchoring means for securing various objects, including, but not limited to aircraft, vehicles, mobile homes, pets, livestock, game nets or tents, to a predetermined position.

Further still, the present invention relates to multi-legged device for use in combination with a plurality of ground stakes for securing such objects to the ground. It is additionally envisioned as a winching anchor for off road vehicles equipped with winches.

Conventional securing devices generally take the form of a cable, chain or rope with either an elongated spike, turnbuckles or in combination with some significant permanent structure embedded in the ground. Although these devices are generally strong enough to sufficiently secure an object, these arrangements suffer from several drawbacks. Where an elongated spike is used such a single spike cannot adequately serve to overcome multi-directional forces on the spike. Further, such a device serves only to provide a solid securement in the right type of soil. In sandy or loose soil, a single elongated spike generally looses its ability to adequately resist even moderate forces.

In the cases of ground-embedded anchoring facilities, significant effort must be exerted to prepare the facilities and their locations are fixed allowing for no movement of the anchored object. For instance, in the case of an aircraft, the user of such a facility must deal with the inconvenience of taxing the aircraft to precisely to a position where it can be effectively secured to the embedded anchors. In either case, the prior art devices lack the combination of lightweight portability and significant securement strength in even somewhat unfavorable soil.

It is, therefore, desirable to provide a securement device capable of retaining an object in a fixed position relative to a predefined location without the use of permanent anchoring facilities. In such context, it is also desirable to provide a compact, lightweight and portable device capable of compact stowage for use in conjunction with boats, aircraft and motor vehicles. Additionally, it is desirable to provide such a device suitable for use in a variety of soil conditions.

SUMMARY OF THE INVENTION

The present invention recognizes and addresses various of the foregoing limitations and drawbacks, and others, concerning securement devices. Therefore, the present invention is directed to a ground anchoring means for securing an object to a fixed position.

It is, therefor, a principle object of the subject invention to provide a securement device for retaining objects in a fixed position relative to a predefined location. More particularly, it is an object of the present invention to provide a compact, lightweight and portable securement device for use in retaining objects in a fixed relative relationship. In such context, it is still a more particular object of the present invention to provide a securement device capable of providing adequate anchoring strength in varied soil types.

Still further, it is a principle object of this invention to provide a multi-legged ground-anchoring device for securing objects in a fixed position. It is a further object of the present invention to provide such a device that is lightweight and capable of compact stowage while retaining the ability to adequately retain even large objects in a fixed position. In such context, it is an object of the present invention to provide such a securement device that is capable of working in coordination with other similar securement devices to secure larger objects such as aircraft and motor homes.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitutions of the equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description).

These and other features, aspects and advantages of the present invention will become better understood with reference to the following descriptions and appended claims. The accompanying drawings, which are incorporated in and constitute a part of this specification, illustrate an embodiment of the invention and, together with the descriptions, serve to explain the principles of the invention.

In one exemplary embodiment, there may be provided a ground anchoring means for securing various objects, including, but not limited to aircraft, vehicles, mobile homes, pets, livestock, game nets or tents, to a predetermined position. In such embodiment, a multi-legged ground-anchoring device is provided. Such device may comprise a centralized hub from which a plurality of legs may extend. Each leg may be individually connected to the central hub by way of a rotational attachment and may be maintained in relative position by way of an opposed pair of guide plates.

At the distal end of each leg may be provided a foot for the angled receipt of a spike. Each spike is angled toward the central hub upon its entry into its respective foot. To engage the device, each leg is rotated upward about its rotational axis. Such action essentially flattens the device to the ground. The spikes may be driven into the ground through the feet thus securing the device to the ground. Finally, an attachment point may be provided to which a rope, cable, wire or other line may be affixed to connect the device and an object to be secured.

Any forces acting upon the line connecting the device and the object it is securing will serve to try and lift the central hub away from the ground. As its central hub is raised the device acts upon the plurality of spikes to essentially "grip" the ground. This "gripping" action is achieved due to the spikes angle of insertion. Such angle is always directed toward the center of the device. Such a device may be used alone or in combination with other devices or even other securement means.

In a second embodiment of the present invention, a pre-tensioning plate may be provided to encourage the device to "grip" the ground prior to the introduction of any forces acting upon the secured object. To achieve such an embodiment, a plate may be attached to the underside of the central hub by way of an eyebolt and nut or other appropriate fastener. The eyebolt may be adjusted so as to force the plate away from the bottom of the central hub while the device is engaged. Essentially this will introduce a force acting to push the device away from the ground rather than as described above a force attempting to pull it away from the ground. Such a force will again initiate the spikes to "grip" the ground to resist such a force. The plate may also be provided with a number of slots equal to the number of legs to allow for compact stowage of the device.

The layout of the present invention inherently adds several beneficial features to the operational capabilities of the device. Among these is its strength in resisting large forces acting upon whatever is being tied down. Similarly, the flattened shape of the device while in use serves to ensure that no unnecessary damage is caused to the tires of any vehicles that may inadvertently drive over the present invention. Unlike most of its contemporaries, the device does not require permanently affixation to a predetermined place. The present invention may be easily disengaged from the ground and moved for use elsewhere due to the limited number of contact points with the Earth. Finally, the device may be made of lightweight metal or hard plastic so as to be easily portable yet very strong.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
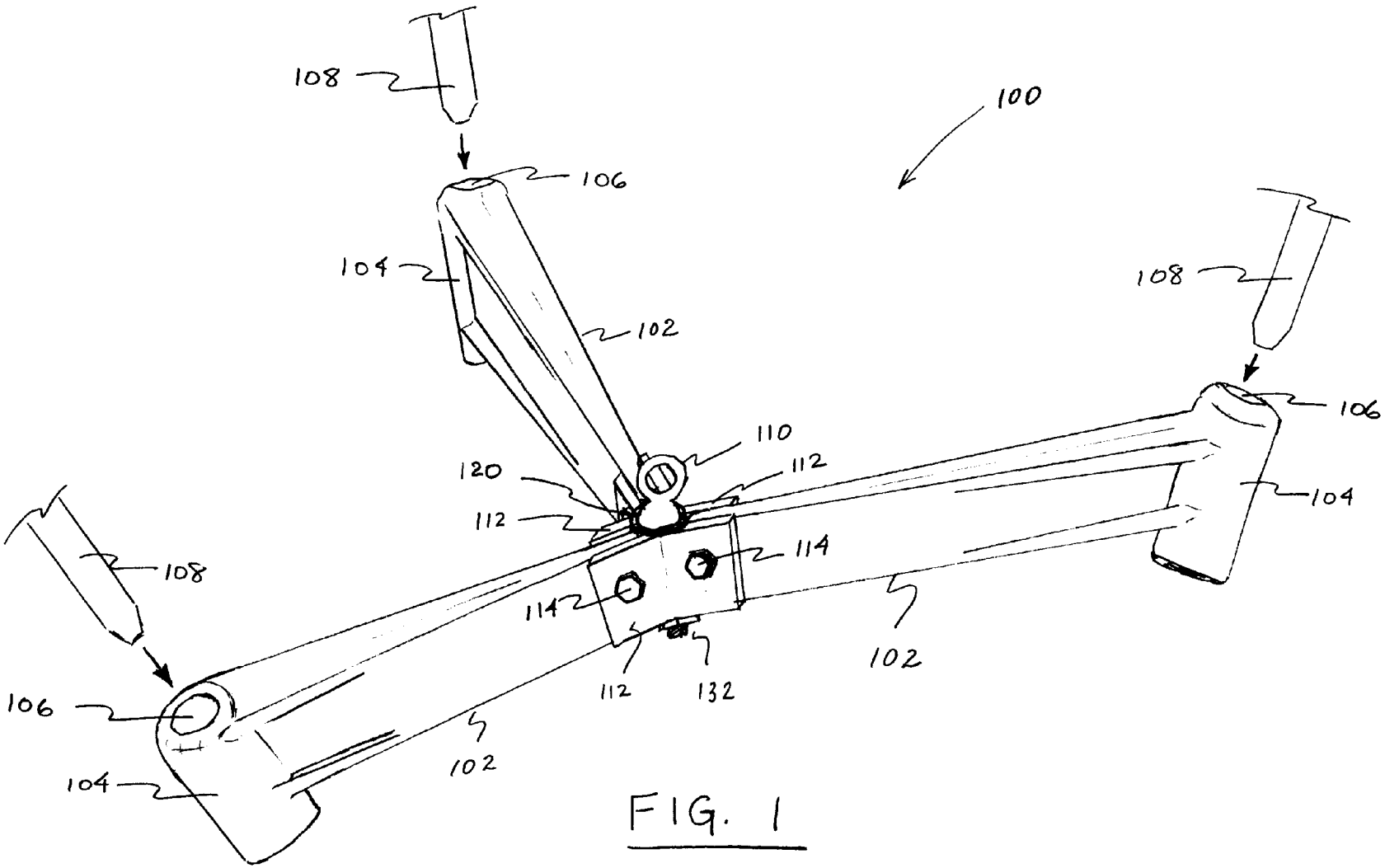
FIG. 1 is an orthogonal view of one embodiment of the present invention showing a three-legged securement device fully opened for use with stakes located for insertion into each leg's respective receiver.

Repeat use of reference characters throughout the present specification and appended drawings is intended to represent the same or analogous features or elements of the invention.

DETAILED DESCRIPTION OF THE PREFERRED EMBODIMENTS

Reference will now be made in detail to presently preferred embodiments of the invention, examples of which are fully represented in the accompanying drawings. Such examples are provided by way of an explanation of the invention, not limitation thereof. In fact, it will be apparent to those skilled in the art that various modifications and variations can be made in the present invention, without departing from the spirit and scope thereof. For instance, features illustrated or described as part of one embodiment can be used on another embodiment to yield a still further embodiment. Still further, variations in selection of materials and/or characteristics may be practiced, to satisfy particular desired user criteria. Thus, it is intended that the present invention cover such modifications and variations as come within the scope of the present features and their equivalents.

Figure 3:
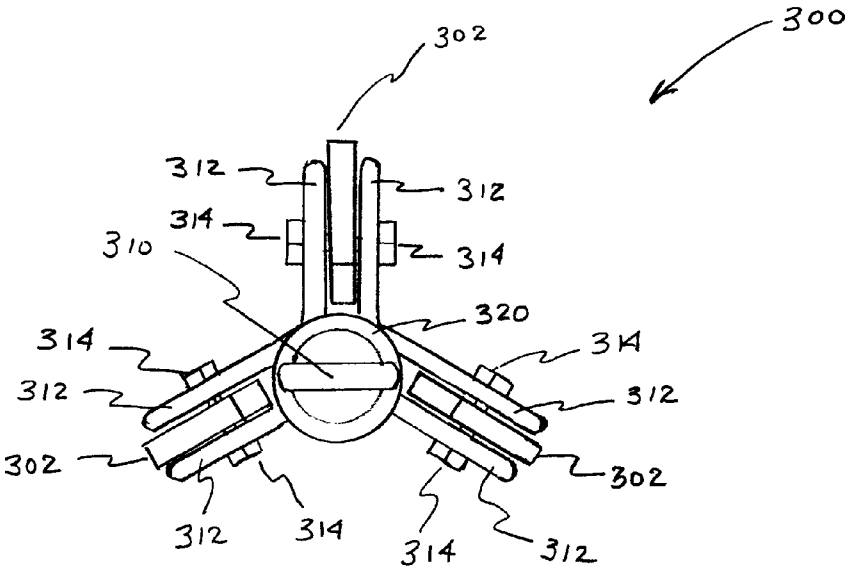
FIG. 3 is an overhead perspective view of one embodiment of the present invention showing a three-legged securement device located about a central hub with the legs collapsed for storage.

As disclosed above, the present invention is particularly concerned with a ground anchoring means for securing various objects, including, but not limited to aircraft, vehicles, mobile homes, pets, livestock, game nets or tents, to a predetermined position. As best seen in FIGS. 1 and 3, one embodiment of the present invention comprises a three-legged anchoring device 100, 300 for securing various objects in a fixed position. The anchoring device 100, 300 is comprised of three legs 102, 302 approximately equally distance apart around the central hub 120, 320 of the device 100, 300. It should be noted that while the present embodiment comprises a three-legged device, alternative embodiments are envisioned comprising three or more legs 102, 302.

In the case of the present embodiment, each leg 102, 320 may be approximately 120° from each other about a central hub 120, 320. A first end of each leg 102, 320 is rotationally attached to a pair of guide plates 112, 312 on either side thereof by way of a fastener 114, 314. The fastener 114, 314 may be permanently affixed so as to secure its respective leg 102, 302 between its respective pair of guide plates 112, 312. Each guide plate 112, 312 may similarly be angled at approximately 120° to simultaneously serve as a guide plate for two adjacent legs 102, 302 while adding to the overall strength of the device 100, 300. Additionally, each opposing pair of guide plates 112, 312 may be connected to each other at the central hub to form a generally Y-shaped framework for the device 100, 300.

Additionally, within the central hub 120, 320, is located an attachment point 110, 310 for securing the ground anchoring device 100, 300 to the object being secured in place. The attachment point 110, 310 may comprise a rotatable ring for ease of use with a rope or other means of affixing the ground-anchoring device 100, 300 to the object being secured.

Figure 2:
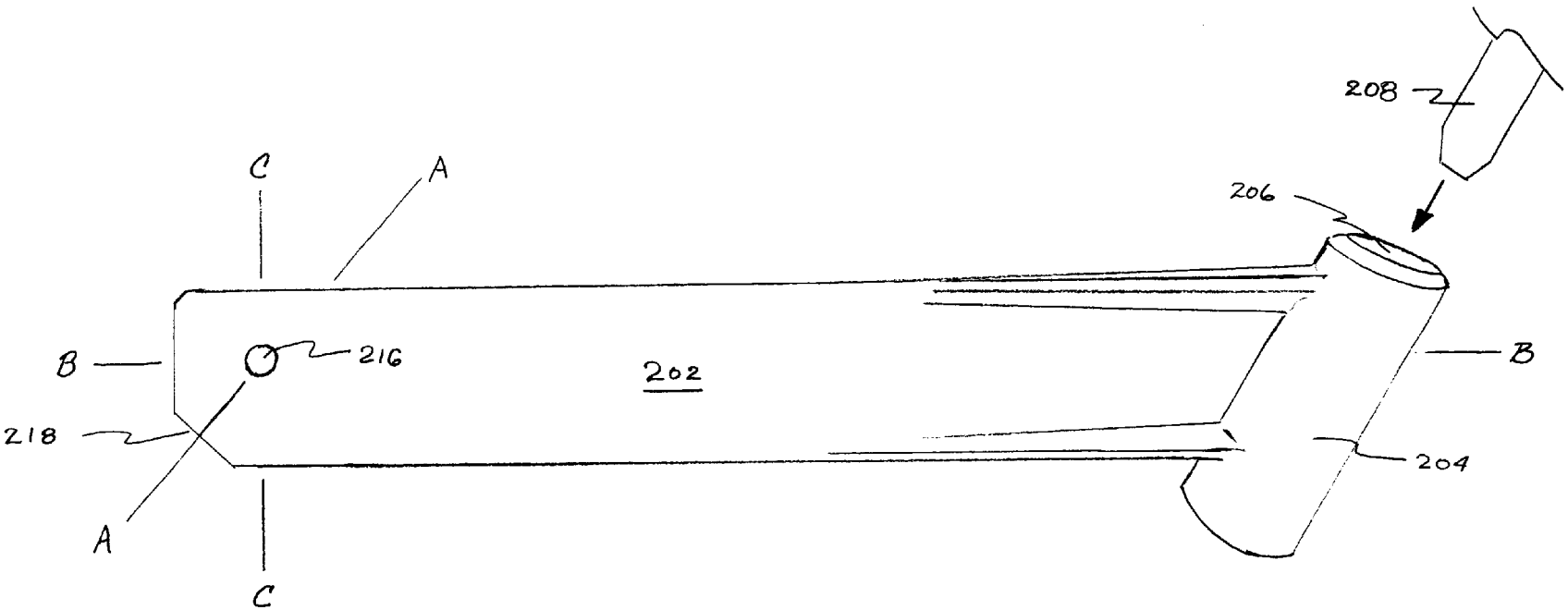
FIG. 2 is a side perspective view of a single leg of the present invention as well as a stake ready for insertion into the leg's receiver.

As best seen in FIGS. 1 and 2, near a first end of each foot 104, 204 may be located a hole 216 for receipt of a fastener 114. Such fastener 114 may run generally parallel to axis A—A about which the leg 102, 202 may partially rotate. The bottom edge 218 of each leg at the first end may be partially removed to avoid any potential obstruction caused by the guide planes 112 and the central hub 120 during such partial rotation about axis A—A. It should be noted that the upper edge of the first end is not removed to ensure each leg 102, 202 does not substantially rotate above the horizontal axis B—B. At the distal end of each leg 102, 202 is a foot 104, 204. Each foot 104, 204 is a generally cylindrical receptacle set at a predetermined angle for receipt of a stake 108, 208 in its generally centrally located hole 106, 206. The foot 104, 204 of each leg 102, 202 may be set at any angle as desired prior to manufacture of the device 100. Generally, the angle of each foot 104, 204 as taken in reference to axis C—C may preferably lie between generally about 40° and generally about 60°. Such angle is preferably generally about 55°.

In addition to the above description, FIG. 3 depicts the present invention as seen from above while in a storage configuration. In such configuration, each leg 302 has been rotated about axis A—A toward the central hub 320. The relationship between each individual leg 302 and its respective pair of opposed guide plates 312 may also be seen. Further, each guide plate 312 may be seen to serve a pair of adjacent legs 302 as discussed above.

Figure 4:
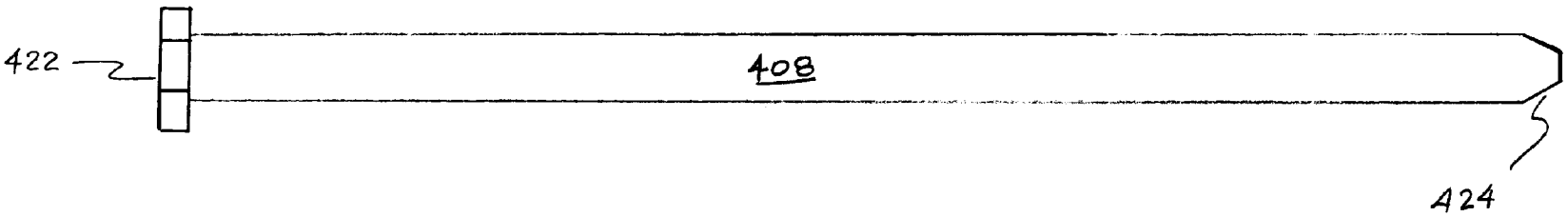
FIG. 4 is a stake for use with the present invention.

As can be seen in FIG. 4, the head 422 of each spike may be significantly larger than the body of the spike 408. Such a configuration would allow the head 422 of the spike to rest upon the outer upper surface of its respective foot 104, 204 so as not to complete pass therethrough. Additionally, as the ground anchoring device 100, 200, 300 is not intended for use in areas where the ground comprises rock, asphalt, concrete or other solid material, the distal end 424 of the spike 408 need not form a sharp point. Instead a slightly tapered end 424 may be provided to aid the spike 408 to pass through tightly compacted soils or heavy clay.

Figure 5:
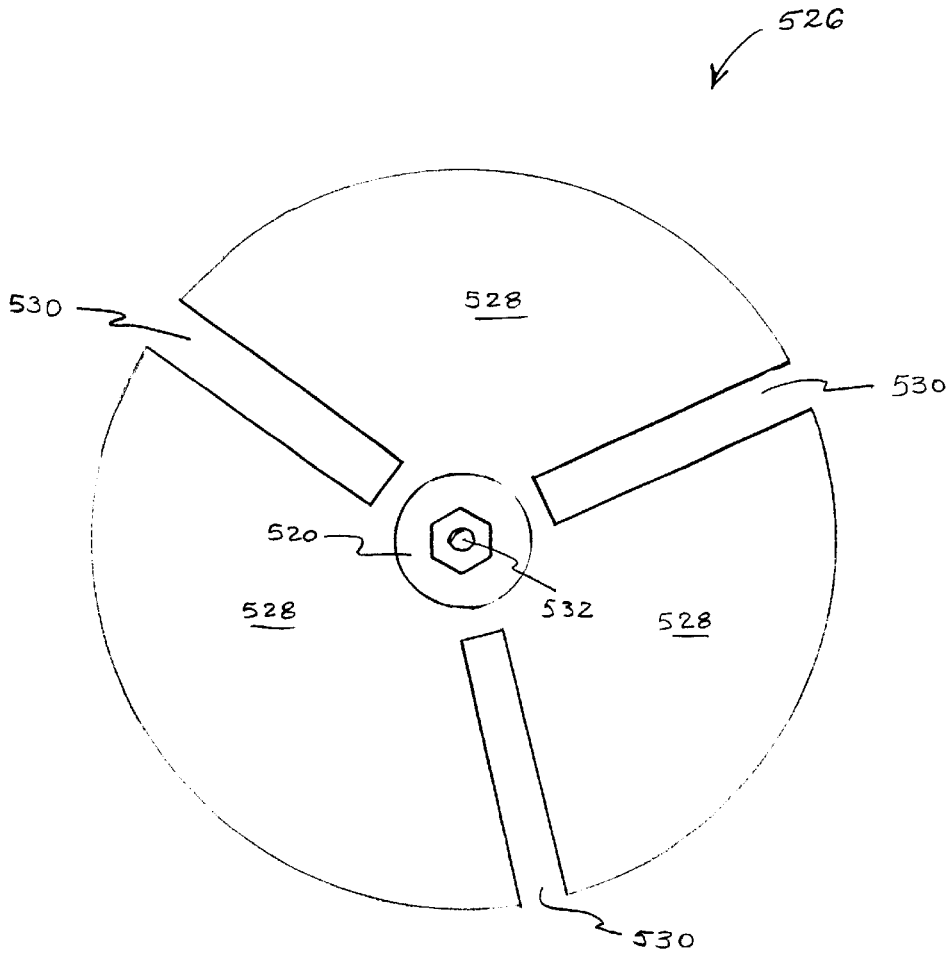
FIG. 5 is a pre-tensioning plate for use with an alternative embodiment of the present invention.
Figure 6:
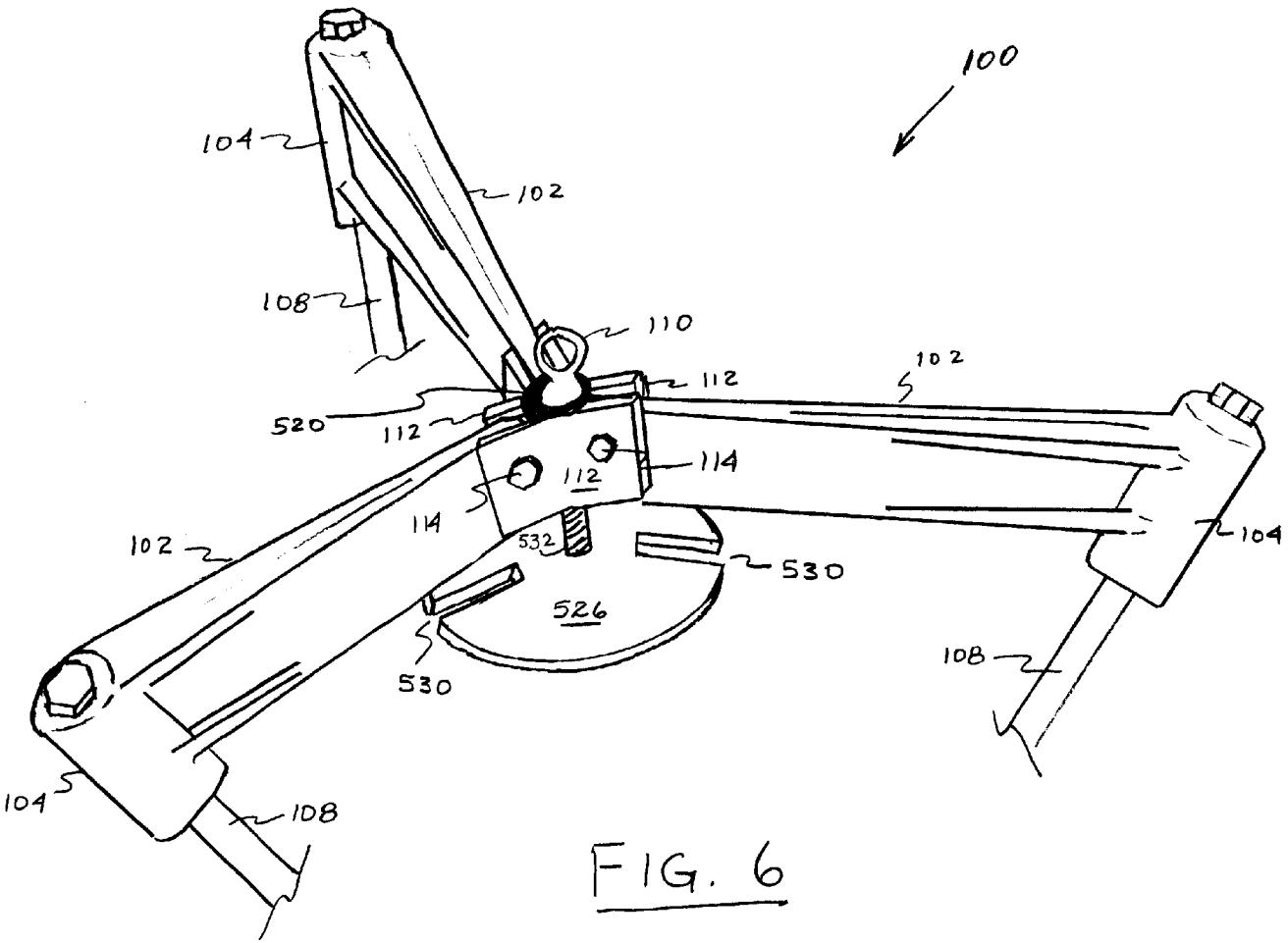
FIG. 6 is an orthogonal view of an alternative embodiment of the present invention showing a three-legged securement device fully opened for use with stakes inserted into each leg's respective receiver and pre-tensioned for resistance to any forces acting thereon.

Finally, FIG. 5 depicts a pre-tensioning plate 526 for use in an alternative embodiment of the present invention as seen from below without the remainder of the device 100, 200, 300. As seen in FIG. 6, this alternative embodiment may be allows for the pre-tensioning of the ground-anchoring device 100, 200, 300. This may be, achieved be attaching a plate 526 to the underside of the central hub 520 by way of a threaded eyebolt and nut 532.

The user may then tighten or loosen the eyebolt and nut 532 to a desired position so as to raise and lower the plate 526 below the device 100, 200, 300. In so doing, a user forces the center of the device upward and thus forces the spikes 108, 208, 408 to become more angled toward the center of the device 100, 200, 300, thus more firmly "gripping" the ground. Such "gripping" is essentially the generation of a counterforce that opposes any force acting to push the device 100, 200, 300 away from the ground.

The pre-tensioning plate 526 may include both blades 528 and slots 530. The blades 528 serve to support the legs 102, 202, 302 of the device 100, 200, 300 as they are forced to gradually rotate downward about axis A—A during the tensioning process. The slots 530 are provided to allow the legs to pass through a portion of the pre-tensioning plate 526 so as to allow for the compact stowage of the device 100, 200, 300 as depicted in FIG. 3.

Although a preferred embodiment of the invention has been described using specific terms and devices, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of various other embodiments may be interchanged both in whole or in part. Therefore, the spirit and scope of the appended claims should not be limited to the description of the preferred version contained herein.

What is claimed is:

1. A securement device, comprising:

a central hub with an attachment point for physically attaching an object to be secured;

a plurality of guide plates attached thereto;

a plurality of legs extending outward from said central hub, wherein each of said legs is rotational attached between an opposing pair of said plurality of guide plates and wherein each of said plurality of legs has a foot at a distal end thereof;

a plurality of spikes, wherein said plurality of spikes equals the number of said plurality of legs and wherein each of said plurality of spikes is for passage through a corresponding one of said feet; and wherein each of said feet is angled so as to force their respective spikes toward said central hub.

2. A securement device as in claim 1, wherein said central hub attachment point is an eyebolt secured with a nut on an underside of said central hub.

3. A securement device as in claim 1, wherein said plurality of guide plates are interconnected connected to form a generally Y-shape framework for said device.

4. A securement device as in claim 3, wherein each of said plurality of legs has a portion of a bottom edge removed at an end opposite the distal end to allow for downward rotational motion of said leg.

5. A securement device as in claim 4, wherein said plurality of legs are generally incapable of rotational motion beyond the horizontal when rotated upwardly.

6. A securement device as in claim 1, wherein the top of each of said feet is angled between generally about 40 degrees and generally about 60 degrees from the horizontal.

7. A securement device as in claim 6, wherein said angle is 55 degrees.

8. A securement device, comprising:

a central hub with an attachment point for physically attaching an object to be secured;

a plurality of legs extending outward from said central hub, wherein each of said legs is rotational attached thereto;

a plurality of spikes, wherein each of said plurality of spikes is for passage through a distal end of one of said corresponding plurality of legs.

9. A securement device as in claim 8, wherein each of said plurality of legs has a foot attached at its distal end.

10. A securement device as in claim 9, wherein each of said plurality of spikes is for passage through a foot of a corresponding one of said plurality of legs.

11. A securement device as in claim 10, wherein the top of each of said feet is angled between generally about 40 degrees and generally about 60 degrees from the horizontal.

12. A securement device as in claim 11, wherein said angle is 55 degrees.

13. A securement device as in claim 8, wherein said central hub further comprises a plurality of guide plates interconnected to form a framework for said device.

14. A securement device as in claim 13, wherein each of said plurality of legs is rotational connected between an opposing pair of said plurality of guide plates.

15. A securement device as in claim 8, wherein each of said plurality of legs has a portion of a bottom edge removed at an end opposite the distal end to allow for downward rotational motion of said leg.

16. A securement device as in claim 15, wherein said plurality of legs are generally incapable of rotational motion beyond the horizontal when rotated upwardly.

17. A securement device, comprising:

a central hub with an attachment point for physically attaching an object to be secured;

a plurality of legs extending outward from said central hub, wherein each of said legs is rotational attached thereto and wherein each of said plurality of legs has a foot at a distal end thereof;

a plurality of spikes, wherein each of said plurality of spikes is for passage through a corresponding one of said feet;

a pre-tensioning plate; and wherein said feet are angled so as to force their respective spikes toward said central hub.

18. A securement device as in claim 17, wherein said central hub further comprises a plurality of guide plates interconnected to form a framework for said device.

19. A securement device as in claim 18, wherein each of said plurality of legs is rotational connected between an opposing pair of said plurality of guide plates.

20. A securement device as in claim 17, wherein each of said plurality of legs has a portion of a bottom edge removed at an end opposite the distal end to allow for downward rotational motion of said leg.

21. A securement device as in claim 20, wherein said plurality of legs are generally incapable of rotational motion beyond the horizontal when rotated upwardly.

22. A securement device as in claim 20, wherein said pre-tensioning plate further comprises a plurality of slots corresponding to the plurality of legs for the passage of said plurality of legs when they are rotated downwardly so as to place said device into a compact stowage configuration.

23. A securement device as in claim 17, wherein said pre-tensioning plate allows for the forced introduction of a force counter to one acting to pull said device from the ground by further engaging the spikes into the ground.

* * * * *